United States Patent [19]

Saito et al.

[11] Patent Number: 4,503,679

[45] Date of Patent: Mar. 12, 1985

[54] OIL COOLER SYSTEM FOR MOTOR VEHICLES WITH TURBO CHARGERS

[75] Inventors: Taiji Saito, Okazaki; Mitsuhisa Kato; Kimioki Yasunaga, both of Toyota, all of Japan

[73] Assignee: Toyota Jidosha Kabushiki Kaisha, Toyota, Japan

[21] Appl. No.: 409,178

[22] Filed: Aug. 18, 1982

[30] Foreign Application Priority Data

Jan. 29, 1982 [JP] Japan ..... 57-12957

[51] Int. Cl.[3] ..... F02B 33/40

[52] U.S. Cl. ..... 60/605; 184/6.11; 184/6.22

[58] Field of Search ..... 60/605; 184/6.11, 6.22

[56] References Cited

U.S. PATENT DOCUMENTS 3,045,420 7/1962 Addie ..... 60/605
3,990,424 11/1976 Miersch ..... 184/6.22
4,126,997 11/1978 Henson ..... 60/605
4,157,744 6/1979 Capriotti ..... 184/6.11

*Primary Examiner*—Douglas Hart
*Attorney, Agent, or Firm*—Oblon, Fisher, Spivak, McClelland & Maier

[57] ABSTRACT

An oil cooler system for a motor vehicle with a turbo charger has an oil circuit which is constituted by a first oil circuit connecting an oil pan, an oil pump, an oil filter, an oil cooler, a turbo charger and the oil pan in that order. A second oil circuit connects the oil pan, the oil pump, the oil filter, a cylinder block of an engine and the oil pan in that order, providing an oil cooler of the partial-flow type (in which, after passage through the oil cooler, the oil is returned to the oil pan through the turbo charger alone). Since the oil which has been cooled through the oil cooler is sent directly to the turbo charger, the oil temperature at the inlet of the turbo charger is effectively lowered.

9 Claims, 11 Drawing Figures

OIL COOLER SYSTEM FOR MOTOR VEHICLES WITH TURBO CHARGERS

BACKGROUND OF THE INVENTION

1. Field of the Invention

This invention relates to an oil cooler system for motor vehicles having an engine with a turbo charger.

2. Description of the Prior Art

In a motor vehicle with a turbo charger, the lubricant/cooling oil to be supplied to the turbo charger should be at a low temperature at the inlet of the turbo charger so as to help cool the turbo charger, since otherwise it is possible that the turbo charger bearings will seize due to the heat which is transmitted from the turbine housing when the engine is stopped after a high speed operation. In the conventional lubrication system for a motor vehicle with a turbo charger, the oil which is supplied from an oil pan 1' through an oil pump 2' and an oil filter 3' is partly circulated through an engine 4' and partly through a turbo charger 5' and then returned to the oil pan 1' as shown particularly in FIG. 11. The oil in the lubrication system is cooled by an oil cooler 6' in a return passage which is connected between the outlet of the oil pump 2' and the oil pan 1'. Therefore, the conventional oil cooler is effective for cooling the oil in the oil pan 1' but cannot be expected to have much cooling effect on the oil at the inlet of the turbo charger 5'.

Moreover, in the conventional oil cooler system of a motor vehicle with a turbo charger, the flow rate of oil to the oil cooler 6' is controlled by a flow control valve 7' which is responsive to the oil pressure (hereinafter referred to as a "pressure-sensitive flow control valve"), so that the oil cooler 6' is put in operation when the oil pressure is over a certain level irrespective of the oil temperature. Consequently, the oil cooler is operated to cool the oil over an unnecessarily wide range, in spite of the possibility of overcooling the engine. Overcooling the engine will cause a drop in mechanical efficiency due to increased frictional resistance of sliding parts as well as a drop in the performance quality of the engine, ultimately resulting in reduced mileage.

SUMMARY OF THE INVENTION

In order to eliminate the above-mentioned problems, the present invention has as its object the provision of an oil cooler system for a motor vehicle with a turbo charger, the system employing a partial-flow type oil cooler in an oil circuit to the turbo charger to circulate the oil which has been cooled through the oil cooler to the turbo charger without passing through the engine block, thereby effectively lowering the oil temperature at the inlet of the turbo charger.

It is another object of the present invention to provide an oil cooler system for a motor vehicle as mentioned above, employing a flow control valve (hereinafter referred to as "oil-temperature sensitive flow control valve") which controls the flow rate of oil to the oil cooler in response to oil temperature instead of the conventional pressure-sensitive flow control valve, thereby optimizing the operational range of the oil cooler and preventing unnecessary cooling of the engine to preclude degradations in the performance quality of the engine and in fuel efficiency.

It is still another object of the present invention to provide an oil cooler system for a motor vehicle of the type mentioned above, employing an oil temperature sensor for a warning lamp to notify the driver of an abnormal increase in the oil temperature due to clogging of the oil cooler or a problem in an oil temperature control, thereby preventing deterioration of the oil and seizure of turbo charger bearings for safe operation.

According to the present invention, there is provided an oil cooler system for a motor vehicle with a turbo charger in which the oil cooler system includes a first oil circuit connecting an oil pan, an oil pump, an oil filter, an oil cooler, a turbo charger and the oil pan in that order. A second oil circuit connects the oil pan, the oil pump, the oil filter, oil passage in the cylinder block of the engine and the oil pan in that order, forming an oil cooler of the partial-flow type (in which, after passage through the oil cooler, the oil is returned to the oil pan through the turbo charger alone), sending the cooled oil from the oil cooler directly to the turbo charger to effectively lower the oil temperature at the inlet thereof.

The oil cooler system of the invention may further include an oil-temperature-sensitive flow control valve at a diverging point of the first and second oil circuits to thereby optimumally control the oil flow to the oil cooler, and/or a warning lamp oil temperature sensor in the first oil circuit between the oil cooler and turbo charger to thereby detect an abnormal increase of the oil temperature due to a problem in the temperature control, or for other reasons, to ensure a high degree of safety.

BRIEF DESCRIPTION OF THE DRAWINGS

The above and other objects, features and advantages of the present invention will be apparent and readily understood from the following detailed description of a preferred embodiment of the invention, taken in conjunction with the accompanying drawings, of which.

DETAILED DESCRIPTION OF THE PREFERRED EMBODIMENT

Figure 1:
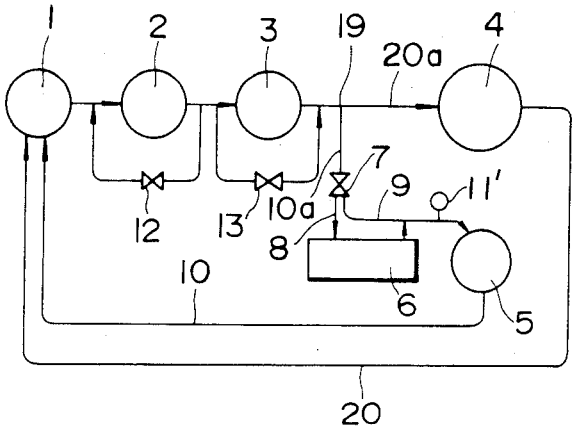
FIG. 1 is a schematic illustration of an oil cooler system for a motor vehicle with a turbo charger, embodying the present invention.
Figure 11:
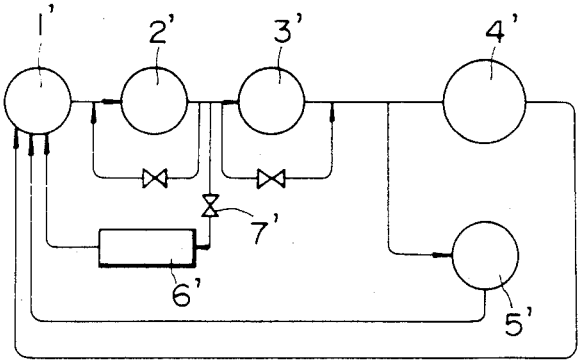
FIG.11 PRIOR ART
FIG. 11 is a schematic illustration of a conventional oil cooler system for a motor vehicle with a turbo charger.

A motor vehicle with a turbo charger incorporating the oil cooler system of the present invention is described more particularly with reference to the accompanying drawings. Referring first to FIG. 1, there is shown schematically an oil cooler system according to the present invention, in which 10 indicates a first oil circuit and at 20 a second oil circuit. The first oil circuit 10 includes along its length an oil pan 1, an oil pump 2, an oil filter 3, an oil cooler 6 and a turbo charger 5, while the second oil circuit 20 includes in its length the oil pan 1, oil pump 2, oil filter 3 and an engine 4. The first and second circuits 10 and 20 are constituted by a single common passage from the oil pan 1 to oil filter 3.

Designated at 7 is an oil-temperature-sensitive flow control valve which is provided past a diverging point where the second oil circuit 20 is branched off the first oil circuit 10. Provided between the oil-temperature-sensitive flow control valve 7 and turbo charger 5 are a high temperature oil passage 8 and a low temperature oil passage 9, with the oil cooler 6 in the high temperature oil passage 8. A warning lamp oil temperature sensor 11' which is connected to a warning lamp is located in the oil circuit 10 between the oil cooler 6 and turbo charger 5. Denoted at 12 is a relief valve for the oil pump 2 and at 13 a relief valve for the oil filter 3. The oil is circulated through the system in the directions indicated by arrows.

The description is now directed to main component units which are provided in the above-described oil circuits.

Figure 2:
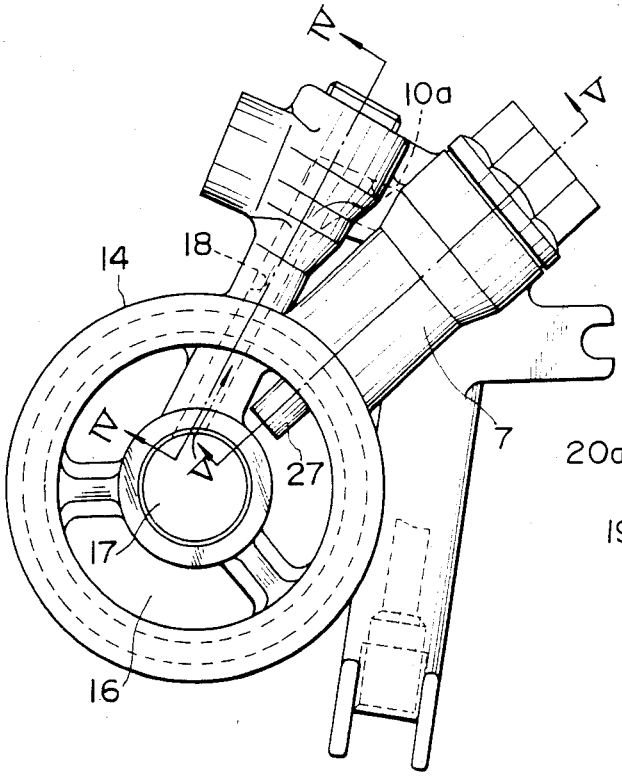
FIG. 2 is a schematic front view of an oil passage in the vicinity of an oil-temperature-sensitive flow control valve.
Figure 3:
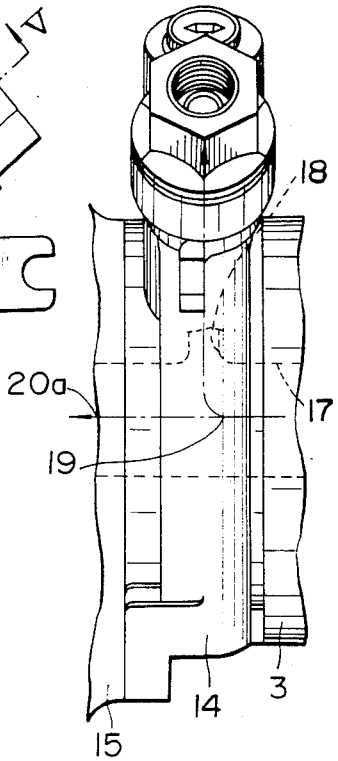
FIG. 3 is a side view of the oil passage of FIG. 2.
Figure 4:
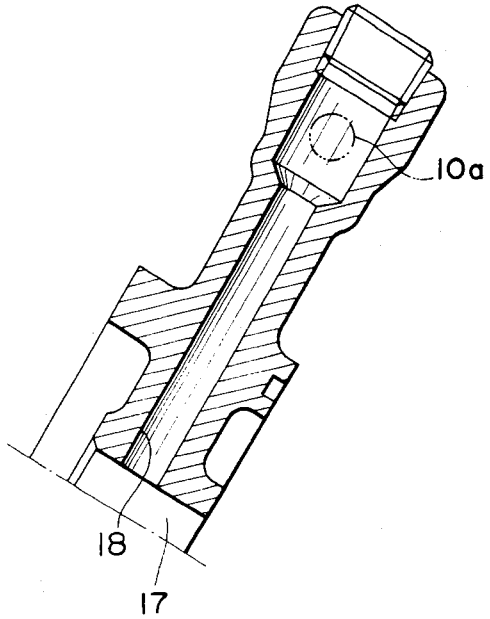
FIG. 4 is a sectional view taken on line IV—IV of FIG. 2.
Figure 5:
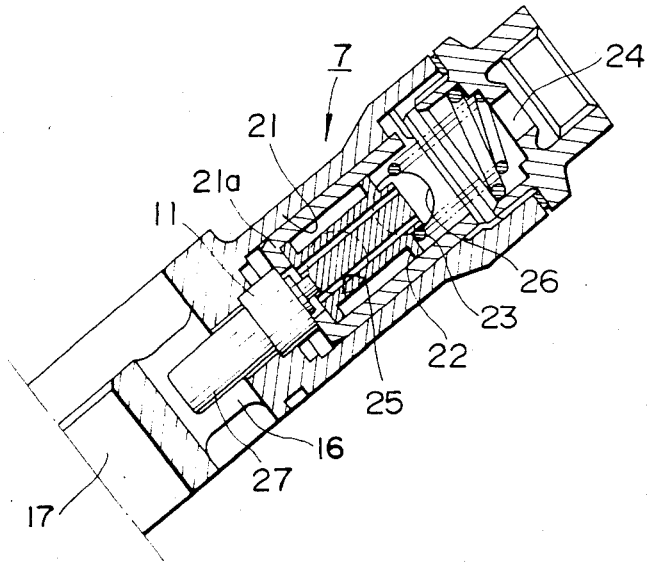
FIG. 5 is a sectional view taken on line V—V of FIG. 2.

Referring to FIGS. 2 to 6, there is shown the construction of oil passages in the vicinity of the oil-temperature-sensitive flow control valve 7. As shown particularly in FIGS. 2 and 3, one side of a bracket assembly 14 is securely attached to a cylinder block 15 of the engine and an oil filter 13 is securely connected to the other side of the bracket assembly 14. As illustrated in FIG. 2, the bracket assembly 14 is provided with an annular oil passage 16 which communicates a main oil manifold of the cylinder block 15 with the oil filter 3 and, concentrically within the annular oil passage 6, with an oil passage 17 which supplies the cleaned oil from the oil filter 3 to the component units located in downstream positions. An oil passage 18 shown in FIG. 4 is branched off the oil passage 17 and extended radially outward. As shown in FIG. 3, the oil passage 17 is connected to a passage **20*a* which supplies the oil to various parts of the cylinder block 4, while the oil passage 18 is connected to an oil passage 10*a* which leads to the oil cooler 6 and turbo charger 5 as indicated by a broken line in FIG. 2. The oil passage 18 is branched off the oil passage 17 at a diverging point 19**.

The oil passage **10*a* is connected to the oil-temperature-sensitive flow control valve 7 which is formed integrally with the bracket assembly 14. As shown particularly in FIG. 5, the oil-temperature-sensitive flow control valve 7 has a cylinder 21, a piston 22 slidably fitted in the cylinder 21, and a spring 23 loaded at one end of the piston 22 to bias the latter in one direction. The cylinder 21 is provided with a port 24 at one end thereof in communication with the turbo charger 5 and with a port 25 at the other end in communication with the oil cooler 6. The above-mentioned oil passage 10*a* is communicated with the cylinder 21 through a port 26 which is provided between the ports 24 and 25. The end of the piston 22 opposite the biasing spring 23 is engaged with an oil temperature sensor 11 of a thermostat type. The oil temperature sensor 11 has its oil-temperature-sensing portion 27 disposed in the annular oil passage 16 to detect the temperature of the oil entering the oil filter 3, displacing the piston 22** according to increases in the oil temperature.

The port 24 is provided in a plug which is removably threaded into the cylinder 21, while the ports 25 and 26 are provided in a sleeve **21*a* which is fitted in the cylinder 21 with a loose fit. Therefore, the sleeve 21*a* is removable from the cylinder 21. The sleeve 21*a* has one end abutted against the plug and the other end against the oil temperature sensor 11, so that the oil temperature sensor 11 can readily be taken out of the flow control valve 7 after removing the sleeve 21*a*. Should the oil temperature at the inlet of the turbo charger be unduly increased due to a problem in the oil temperature sensor 11, or by malfunctioning of a sliding portion of the piston 22, it is possible to replace the sensor 11 or piston 22** individually instead of replacing the whole assembly. This contributes to a reduction in the cost of maintenance to a considerable degree.

Figure 6:
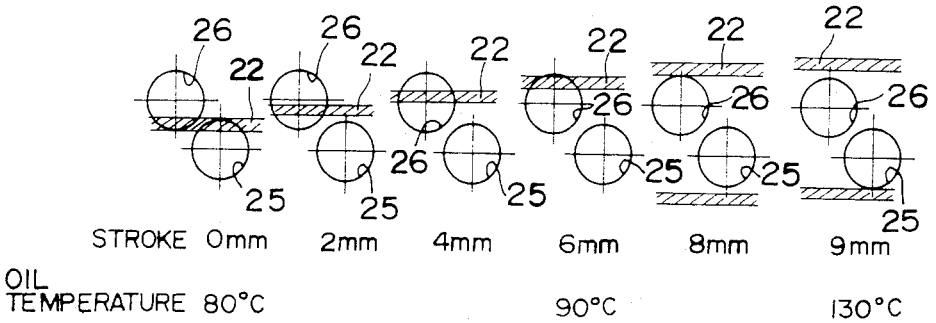
FIG. 6 is a diagrammatic illustration showing the positions of various ports of the oil-temperature-sensitive flow control valve in relation with its piston.

The piston 22 of the valve 7 is displaced according to the oil temperature to control the ports 25 and 26 which are positioned in the relation shown in FIG. 6. More specifically, when the oil temperature is above 90° C., the piston 22 is located between the ports 26 and 24, thus communicating the ports 26 and 25 with each other. Therefore, at an oil temperature level over 90° C., all of the oil which flows through the first oil passage 10 is passed and cooled through the oil cooler 6. However, if the oil temperature drops below 90° C., the piston 22 is held in a position where it bisects the port 26, so that the oil which flows into the cylinder 21 through the port 26 is circulated partly to the turbo charger 5 through the low temperature passage 9 and partly to the oil cooler 6. If the oil temperature further drops to a level below 80° C., the piston 22 is shifted to a position between the ports 26 and 25, so that the oil which flows into the cylinder 21 through the port 26 is entirely circulated to the turbo charger 5 through the low temperature oil passage 9, without being routed through the oil cooler 6. It is possible to alter the above-mentioned critical temperature of 90° C. and 80° C. to some extent, for example in the range of ±10° C., and it is to be noted that the present invention includes all such alterations.

Figure 7:
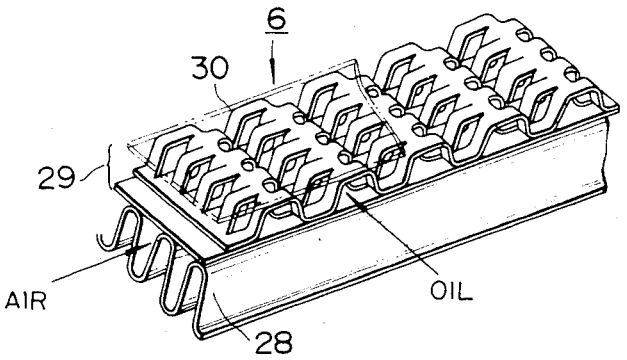
FIG. 7 is a fragmentary perspective view of the internal structure of the oil cooler.
Figure 8:
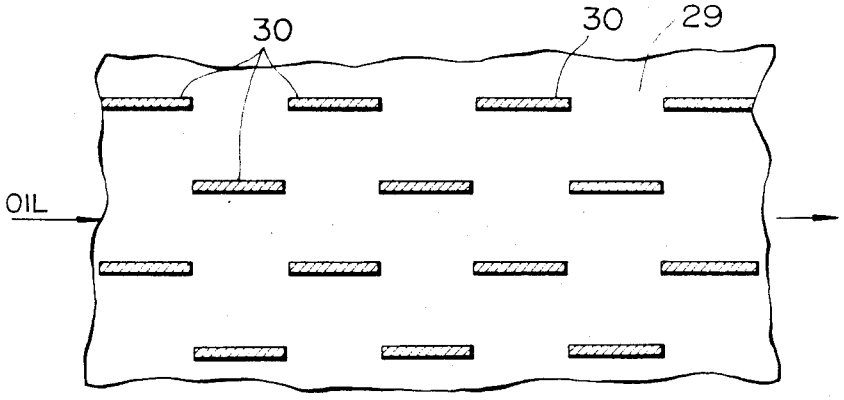
FIG. 8 is a fragmentary section of inner fin portions of the oil cooler of FIG. 7.

FIG. 7 shows an internal part of the oil cooler 6 which is constituted by a cooling fin 28 and a flat tube 29 which are over-lapped one on the other to provide passages for the cooling air and oil respectively. The flat tube 29 is internally provided with inner fins 30. As seen in FIG. 8 which shows the inner fins 30 in relation with the flow direction of the oil, the individual inner fins 30 are so positioned that they extend parallel with the oil flow. This is because if the inner fins are disposed perpendicular to the oil flow, there will arise the possibility of foreign material in the oil accumulating on the inner fins to cause clogging of the oil cooler.

Figure 9:
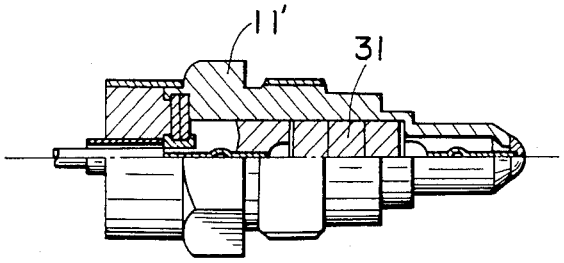
FIG. 9 is a sectional view of an oil temperature sensor for the warning lamp, which is shown in FIG. 1.

The oil temperature sensor 11' for the warning lamp, which is shown particularly in FIG. 9, is provided with a thermoferrite switch assembly 31 which is accommodated in a casing, and arranged to illuminate an oil temperature warning lamp, not shown, which is provided in the passenger compartment of the vehicle when the oil temperature exceeds 130° C. The critical temperature of 130° C. may also be altered in the range of ±10° C.

Figure 10:
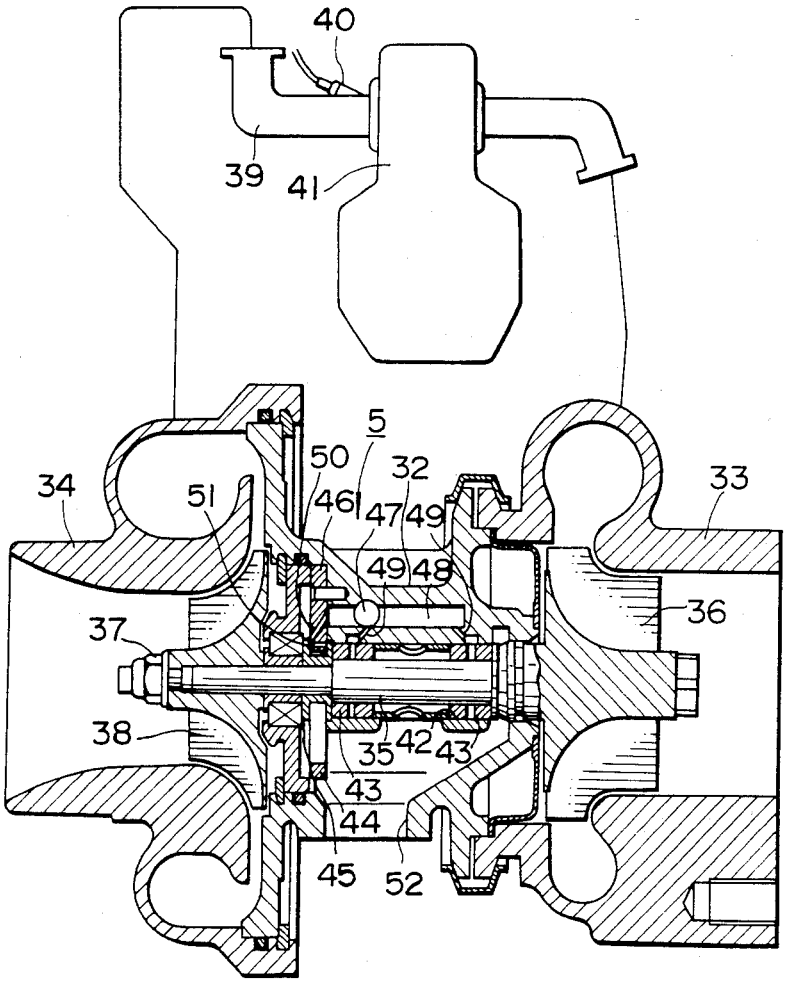
FIG. 10 is a sectional view of a turbo charger as connected to an engine.

Referring to FIG. 10, there is shown the construction of the turbo charger and adjoining component parts, along with the construction of its bearing portions which are to be cooled off. The turbo charger 5 includes a center housing 32, a turbine housing 33 securely fixed to one end of the center housing 32, a compressor housing 34 securely fixed to the other end of the center housing 32, a rotational shaft 35 rotatably fitted in the center housing 32, a turbine wheel 36 formed integrally at one end of the rotational shaft 35, and an impeller 38 fixedly mounted at the other end of the rotational shaft 35 by a nut 37. The air in the compressor housing 34, which is compressed by rotation of the impeller 38, is sent to the intake manifold 39 of the engine and to the engine cylinders 41 along with a fuel which is injected by a fuel injector valve 40. The exhaust gas from the engine cylinder 41 is drawn into the turbine housing 33 to impart a rotational force to the turbine before discharging same. At this time, the heat of the exhaust gas is transmitted to the center housing 32 through the turbine housing 33.

The center housing 32 is provided with a pair of floating radial bearings 43 at spaced positions in a bearing support bore 42 which is formed through the center housing 32, rotatably supporting the rotational shaft 35 by the floating radial bearings 43. A thrust bearing 44 is provided at a reduced diameter portion of the rotational shaft 35 to support the axial load of the rotational shaft 35. The thrust bearing 44 consists of a runner member 45 and a fixed bearing plate 46 which is fitted in the groove of the runner member 45. Thus, the main bearing system of the turbo charger 5 is constituted by the floating radial bearings 43 and thrust bearing 44.

The center housing 32 is provided with an oil inlet 47 and an oil distributing bore 48, receiving the oil in the first oil circuit 10 at the oil inlet 47. A pair of oil supply holes 49 which extend from the oil distributing bore 48 toward the floating radial bearings 43 supply the oil to the respective radial bearings. On the other hand, the thrust bearing 44 is supplied with the oil through oil holes 50 and 51 which are formed through the fixed bearing plate 46. The oil which is supplied to the bearings 43 and 44 serve to lubricate the respective bearings and at the same time to cool the bearings 43 and 44 by removing the heat which is transmitted from the center housing 32, before the oil falls and returns to the oil pan 1 through an oil exit 52.

The operation and resulting effects of the above-described oil cooler system are as follows.

The oil in the oil pan 1 flows into the first and second oil circuits 10 and 20. In the first oil circuit 10, the oil which is cooled through the oil cooler 6 is immediately fed to the turbo charger 5. Therefore, the oil cooler 6 is effective for cooling the turbo charger 5 by lowering the oil temperature at the inlet thereof. Consequently, the oil cooler prevents thermal deterioration of the oil and seizure of bearings 43 and 44 of the turbo charger 5. Moreover, as the oil cooler 5 is controlled by the oil-temperature-sensitive flow control valve 7, as shown in FIG. 6, the oil temperature at the inlet of the turbo charger 5 is maintained at a level of about 80° C. to 90° C. irrespective of fluctuations in the oil pressure, maintaining an appropriate oil temperature at the inlet without initiating unnecessary or excessive cooling operations. That is, the system is controlled not indirectly by the oil pressure but directly by the oil temperature, which reduces the possibility of engine overcooling and is advantageous from the stand-points of performance quality, fuel efficiency and emissions of the engine.

The oil cooler 6 is provided between the oil filter 3 and turbo charger 5 so that cleaned oil is fed to the oil cooler 6 from the oil filter 3 at high oil temperatures, thus preventing clogging of the oil cooler 6. The inner fins 30 of the oil cooler 6 which are disposed parallel with the oil flow also are less likely to clog the oil cooler 6. Further, since the oil cooler 6 is of a partial-flow type, its clogging is less likely to cause engine problems, for instance, seizure of the main bearings.

Should the oil temperature at the inlet of the turbo charger be increased to over about 130° C. due to, for example, clogging of the oil cooler or a problem in the oil temperature control (e.g., no oil flow to the high temperature side), this is detected by the warning lamp oil temperature sensor 11' which is provided in the system and the warning lamp is illuminated, urging the driver to take some suitable measure to prevent deterioration of the oil and seizure of the turbo charger bearings.

Thus, the oil cooler system of the present invention makes it possible to lower the oil temperature at the inlet of the turbo charger without entailing overcooling of the engine and to optimize the operation of the oil cooler according to the oil temperature.

Although only a preferred embodiment of the present invention has been described in detail, it will be appreciated by those skilled in the art that various modifications and alterations can be made to the particular embodiment shown without materially departing from the novel teachings and advantages of this invention. Accordingly, it is to be understood that all such modifications and alterations are included within the scope of the invention as defined by the following claims.

What is claimed as new and desired to be secured by Letters Patent of the United States is:

1. An oil cooler system for a motor with a turbo charger, comprising:

a first oil circuit connecting an oil pan, an oil pump, an oil filter, an oil cooler, a turbo charger and said oil pan in that order; and a second oil circuit connecting said oil pan, said oil pump, said oil filter, oil passages in a cylinder head and block of said motor and said oil pan in that order.

2. An oil cooler system as defined in claim 1 wherein said first and second oil circuits comprise in part a single circuit, further comprising an oil-temperature-sensitive flow control valve provided downstream of a diverging point of said first and second oil circuits to control the flow rate of oil in response to the oil temperature, said flow control valve having an oil temperature sensor for operating said flow control valve according to the oil temperature.

3. An oil cooler system as defined in claim 2, wherein said first oil circuit has, between said flow control valve and said turbo charger, a low temperature oil passage for passing oil at low oil temperatures and a parallel high temperature oil passage for passing oil at high oil temperatures, and said oil cooler is provided in said high temperature oil passage.

4. An oil cooler system as defined in claim 3, wherein said flow control valve comprises a cylinder having a first opening formed at one end thereof in communication with said low temperature oil passage, a second opening formed at the other end thereof in communication with said high temperature oil passage and a third opening formed between said first and second openings in communication with said diverging point of said first and second circuits, a piston slidably fitted in said cylinder, and a biasing spring contacting said piston for urging said piston toward said second opening, and wherein said oil temperature sensor is a thermostat type sensor combined with said flow control valve in such a manner as to push said piston toward said first opening as the oil temperature is increased.

5. An oil cooler system as defined in claim 4, wherein said piston is removably held in said flow control valve, and said cylinder is provided with a sleeve detachably held on the inner periphery thereof, permitting disassembly of said oil temperature sensor from said flow control valve after removing said sleeve.

6. An oil cooler system as defined in claim 4, wherein said flow control valve is constructed and adapted to pass the entire flow of oil in said first oil circuit to said high temperature oil passage when the oil temperature is substantially higher than 90° C., to distribute the oil in said first oil circuit to both of said high and low temperature passages when the oil temperature is substantially in the range of 90° C. to 80° C., and to pass the entire flow of oil in said first oil circuit to said low temperature oil passage when the oil temperature is substantially lower than 80° C.

7. An oil cooler system as defined in claim 2, wherein a second oil temperature sensor for a warning lamp is provided between said oil cooler and said turbo charger.

8. An oil cooler system as defined in claim 7, wherein said second oil temperature sensor for a warning lamp is constructed and adapted to be actuated when the oil temperature reaches substantially 130° C.

9. An oil cooler system as defined in claim 8, wherein said oil cooler includes a tube with inner fins for passing the oil therethrough, said inner fins being disposed parallel with the flow direction of said oil.

* * * * *